US005600290A

United States Patent [19]

Anderson, II

[11] Patent Number: 5,600,290

[45] Date of Patent: Feb. 4, 1997

[54] HERMETICALLY SEALED ELECTROMAGNETIC WINDOW AND METHOD OF FORMING THE SAME

[75] Inventor: Theodore G. Anderson, II, Hermosa Beach, Calif.

[73] Assignee: Hughes Aircraft Company, Los Angeles, Calif.

[21] Appl. No.: 523,706

[22] Filed: Sep. 5, 1995

[51] Int. Cl.[6] ..... H01P 1/08

[52] U.S. Cl. ..... 333/252; 29/DIG. 4; 228/124.6

[58] Field of Search ..... 333/252; 315/39.53; 228/122.1, 124.1, 124.6, 56.3, 170, 246; 29/600, DIG. 4

[56] References Cited

U.S. PATENT DOCUMENTS 3,210,699 10/1965 Tagano ..... 333/252

4,286,240 8/1981 Shively et al. ..... 333/252

5,136,272 8/1992 Kormann et al. ..... 333/252

OTHER PUBLICATIONS

Hughes Aircraft Company; "8910H 4.0 kW 33.5 – 36.5 GHz TWT"; Product Sheet Form 19064 ED REV May 89.

*Primary Examiner*—Paul Gensler

*Attorney, Agent, or Firm*—Elizabeth E. Leitereg; Terje Gudmestad; Wanda K. Denson-Low

[57] ABSTRACT

A hermetically sealed electromagnetic window is formed by butt end brazing an overhanging dielectric window between first and second waveguide segments. The waveguide segments have opposed knife edges with a dielectric insert positioned between the knife edges. A pair of brazing forms are inserted between the insert and the two knife edges. The window is heated, causing the brazing material to reflow and provide a hermetic seal between the insert and the waveguide segments, and a conductive path between the waveguide segments.

20 Claims, 3 Drawing Sheets

HERMETICALLY SEALED ELECTROMAGNETIC WINDOW AND METHOD OF FORMING THE SAME

BACKGROUND OF THE INVENTION

1. Field of the Invention

The present invention generally relates to hermetically sealed electromagnetic (EM) windows and fabrication method.

2. Description of the Related Art

Radio frequency (RF) windows are used to provide a vacuum seal for RF devices, such as an RF amplifier and a low loss, low reflection transmission path for the RF energy entering and exiting the device. The RF device is typically provided with RF input and output ports with hermetically sealed RF windows, allowing the device to be vacuum sealed. In the case of an amplifier, an electron gun is used whose heater element will oxidize and degrade the amplifier's performance unless it is vacuum sealed.

Hughes Aircraft Company produces Traveling Wave Tubes (TWTs) that incorporate RF windows. One such TWT is the 8910H disclosed in a May, 1989 product sheet. The RF window is presently formed by inserting a dielectric insert into a waveguide, and brazing the insert to the waveguide's inner walls to form a hermetical seal. The dielectric is preferably a ceramic such as aluminum oxide $Al_2O_3$or beryllium oxide (BeO), which have good RF and mechanical properties and relatively low dielectric losses. FIG. 1 is a plot 10 of the insert's absorption losses ($T_E$) versus frequency for a particular RF window. The insert provides a low loss passband 12 or "window" between approximately 8 and 10 GHz, and a high loss stopband 14 outside that frequency range. The insert's material and thickness are chosen to provide the desired RF passband for a given waveguide shape, typically rectangular or circular.

FIG. 2 is a perspective view of the RF window 16 produced by Hughes. The window comprises a unitary rectangular waveguide 18 and a dielectric insert 20. The dielectric insert 20 is positioned in the waveguide 18 such that its peripheral edge 22 contacts the waveguide's inner walls 24. The technique used to form a hermetic seal is illustrated in FIGS. 3*a* and 3*b*. As shown in FIG. 3*a*, the waveguide is positioned upright and a wire loop 26 of brazing material is inserted through the top of the waveguide and positioned along an edge 28 that is formed by the waveguide's inner walls and the insert. As shown in FIG. 3*b*, when the waveguide is heated the brazing material liquifies and reflows between the insert's peripheral edge and the waveguide's inner walls to form a hermetic seal 30.

The insert's size and shape must match the inner dimensions of the waveguide to a very exact tolerance, typically at most 25.4μm. If the insert is too big, it will not fit. Conversely, if the insert is too small, the hermetic seal will be weak. Hence, machining the waveguide and the insert is a very slow, complicated and expensive process.

The insert must be positioned in the waveguide at a predetermined location such that it is perpendicular to the waveguide's inner walls and parallel to the end of the waveguide. If the insert is positioned incorrectly the hermetic seal will be weakened and the electrical characteristics of the window will be degraded. A specially made tool (not shown) is used to hold the insert in the correct position until the seal is formed. The tool is expensive, wears out relatively quickly, is tedious to use and holds the insert only in approximately the desired position.

The window is suitably heated up to approximately 1000° C. for several hours to form the hermetic seal. Waveguides are preferably light weight Kovar® tubes that are lined with copper, although they may be solid copper. The waveguides have a thermal coefficient of expansion of approximately twice that of the ceramic insert at the brazing temperature. During brazing the waveguide tries to expand away from the insert, thus weakening the hermetic seal. To mitigate this problem, the tool is also used to squeeze the waveguide and prevent its expansion. If the pressure on the waveguide is too low, the waveguide will expand and weaken the seal. If the pressure is too high, the liquified material will not be able to flow between the insert's peripheral edge and the waveguide's inner walls, which will also weaken the seal. To further reduce the stress on the hermetic seal, the waveguide's walls are very thin so that they can flex as the temperature changes. However, the thinner walls weaken the waveguide.

The RF window and the process for constructing the hermetic seal are very slow and expensive because of the tight machining tolerances that are required, the use of the specially made tool, and the unequal thermal expansion between the waveguide and the insert. Furthermore, the RF windows have only approximately a 50% yield rate.

SUMMARY OF THE INVENTION

The present invention provides a hermetically sealed electromagnetic window and a simple and inexpensive method for forming the window that eases the machining tolerances, diminishes thermal expansion problems, strengthens the waveguide and increases the yield rates.

This is accomplished with the use of two waveguide segments having respective knife edges. The waveguide segments are positioned such that their knife edges are facing each other. A dielectric insert is positioned between the two waveguide segments such that its bottom surface contacts the first knife edge and its top surface contacts the second knife edge. A pair of brazing forms are then inserted between the insert's top and bottom surfaces and the first and second knife edges, respectively. The window is heated such that the brazing material reflows to provide a hermetic seal between the insert and the waveguide segments.

For a better understanding of the invention, and to show how the same may be carried into effect, reference will now be made, by way of example, to the accompanying drawings.

DETAILED DESCRIPTION OF THE INVENTION

The invention provides a hermetically sealed EM window, and a method for constructing the window, that maintains a difference in atmospheric pressure on opposite sides of the window and provides a low loss, low reflection transmission path for EM energy through the window. Typically, a pair of hermetically sealed EM windows are used to vacuum seal an EM device from the ambient atmospheric pressure. The invention is applicable to frequencies ranging from the ultra high frequency (UHF) portion of the RF band at the low end, the visible spectrum, up to the x-ray band. For example, a pair of EM windows can be used to vacuum seal an RF amplifier, a microwave magnetron or an x-ray magnetron. The specific type of waveguide and dielectric material used will depend upon the specific application. The EM window described herein is an RF window that has a rectangular cross section. The window can have other shapes, but rectangular and circular cross sections are the most common.

Figure 1:
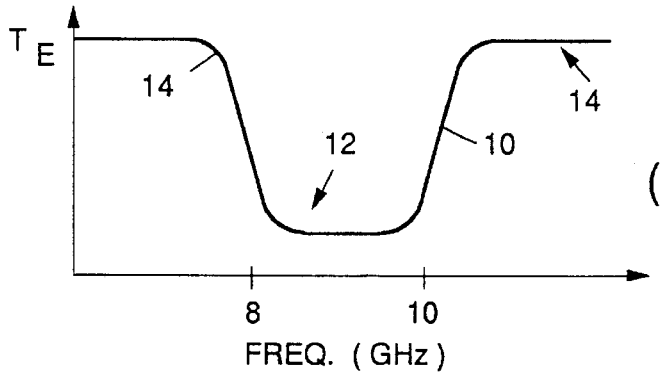
FIG. 1. ( prior art )
FIG. 1, as described above, is a plot of the RF energy absorption of a prior RF window versus frequency.
Figure 2:
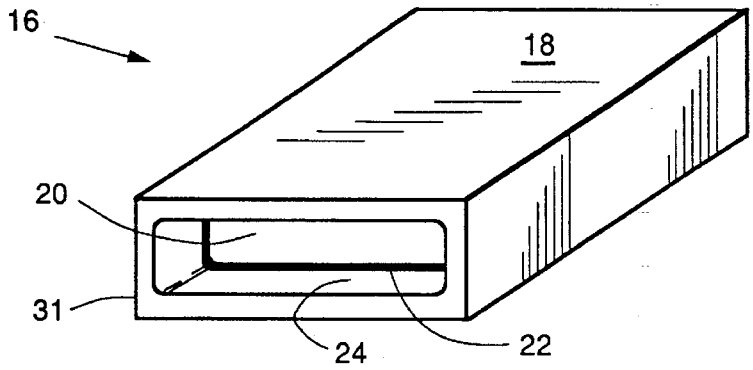
FIG. 2. ( prior art )
FIG. 2, as described above, is a perspective view of a conventional RF window.
Figure 3A:
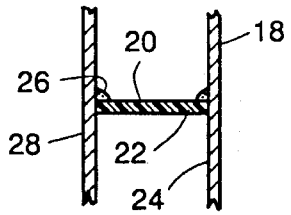
FIG. 3a. ( prior art )
FIGS. 3*a* and 3*b*, as described above, are sectional views of the RF window shown in FIG. 2 before and after brazing, respectively.
Figure 3B:
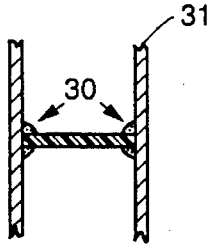
FIG. 3b. ( prior art )
Figure 4:
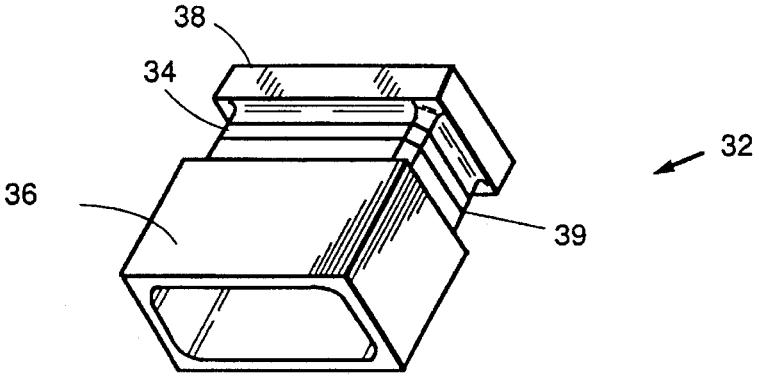
FIG. 4 is a perspective view of a hermetically sealed EM window in accordance with the present invention.
Figure 5A:
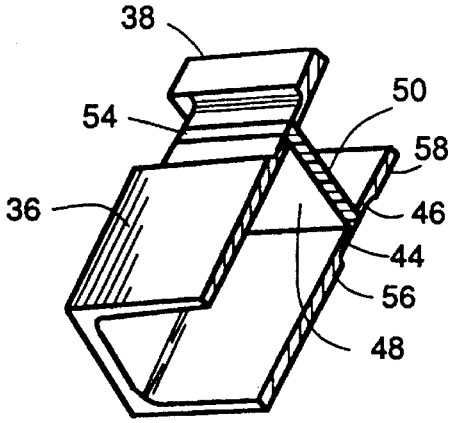
FIGS. 5*a* and 5*b* are sectional views of the EM window shown in FIG. 4 taken along vertical and horizontal section lines, respectively.
Figure 5B:
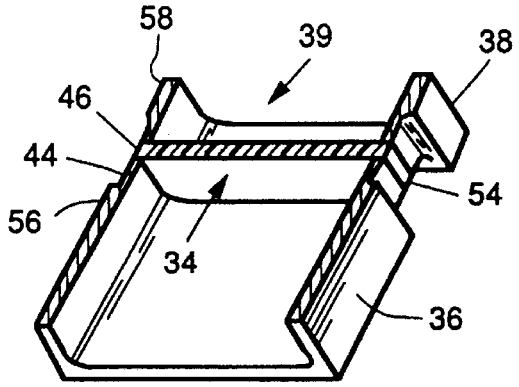

FIGS. 4, 5*a* and 5*b* taken together show an RF window 32 in accordance with the present invention. The window is constructed by "butt end" brazing a dielectric insert 34 between bottom and top waveguide segments 36 and 38, respectively, to form a hermetic seal 39. The waveguide segments are preferably Kovar® tubes that are lined with copper to provide a conductive surface. The insert is preferably a ceramic such as aluminum oxide or beryllium oxide. The physical dimensions of the waveguide segments and of the insert depend upon the particular application. Specifically, the thickness of the insert is selected to provide the desired passband.

The waveguide segments 36 and 38 are thinned to form edges 44 and 46, respectively, at their opposed ends. The edges can be very thin, for example approximately 0.05 cm, and hence are commonly referred to as "knife" edges. The actual thickness of the knife edges can vary with the overall dimensions of the waveguides, and should not be construed to limit the invention to only very thin waveguides. The waveguide segments typically have the same shape and cross sectional area at their knife edges. The insert 34 is preferably oversized so that its cross-sectional area is approximately 5–10% greater than the cross-sectional areas of the waveguide segments at their knife edges. The knife edges 44 and 46 are brazed to the insert' opposite surfaces 48 and 50, respectively, to form the hermetic seal 39. The conductive brazing material on either surface of the insert is reflowed such that the material adheres to the insert's peripheral edge 54 to provide a conductive path between the waveguide segments.

As shown in FIGS. 5*a* and 5*b*, the walls 56 and 58 of the waveguides 36 and 38, respectively, are thinned to provide the knife edges 44 and 46 and to increase their flexibility so that the stress on the hermetic seal 39 between the insert and the waveguide segments due to thermal expansion of the segments during brazing and subsequent thermal cycles is reduced. In the preferred embodiment, the waveguide's wall thickness is typically 2–3 times the thickness of the knife edge to improve the window's overall strength. A knife edge width, parallel to the waveguide axis, of about four times its thickness has been shown to provide adequate flexibility. Increasing its width will increase the knife edge's flexibility and/or facilitate a thicker knife edge. Alternatively, the wall thickness could be as thin as the knife thickness which would weaken the waveguide, or the wall thickness could be tapered from a greater thickness down to the thickness of the knife edge.

Figure 6:
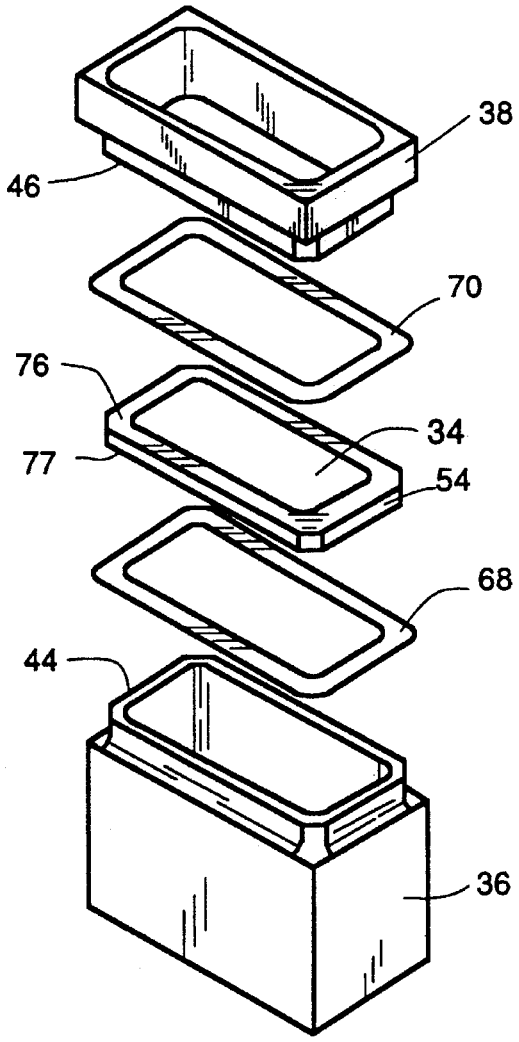
FIG. 6 is an exploded perspective view of the EM window shown in FIG. 4.

FIG. 6 shows the elements of the RF window 32 prior to brazing comprising the bottom waveguide segment 36, an annular braze form 68, the ceramic insert 34, a second annular braze form 70 and the top waveguide segment 38. The insert's peripheral edge 54, and annular regions 76 and 77 on its top and bottom surfaces that are adjacent the peripheral edge, are preferably metalized to reduce RF leakage through the insert and to improve the electrical contact between the waveguide segments. The braze forms are suitably 50% gold and 50% copper and approximately 0.0025 cm thick. The primary requirement of the brazing material is that it must liquify at a lower temperature than either the waveguide segments or the insert, and solidify to form a strong hermetic seal.

The first braze form 68 is placed on top of the bottom waveguide segment's knife edge 44 such that the form extends beyond the knife edge to both the interior and exterior surfaces of the waveguide segment 36. The insert 34 is placed on top of the braze form such that its metalized annular region 77 contacts the brazing form, and is dimensioned to extend outwardly past the knife edge 44 but short of the edge of the braze form. The second braze form 70 is laid on top of the insert's metalized region 76 and overhanging the insert. The knife edge 46 of the top waveguide segment 38 is placed on top of the braze form 70 so that the knife edges and waveguide segments are aligned.

Figure 7A:
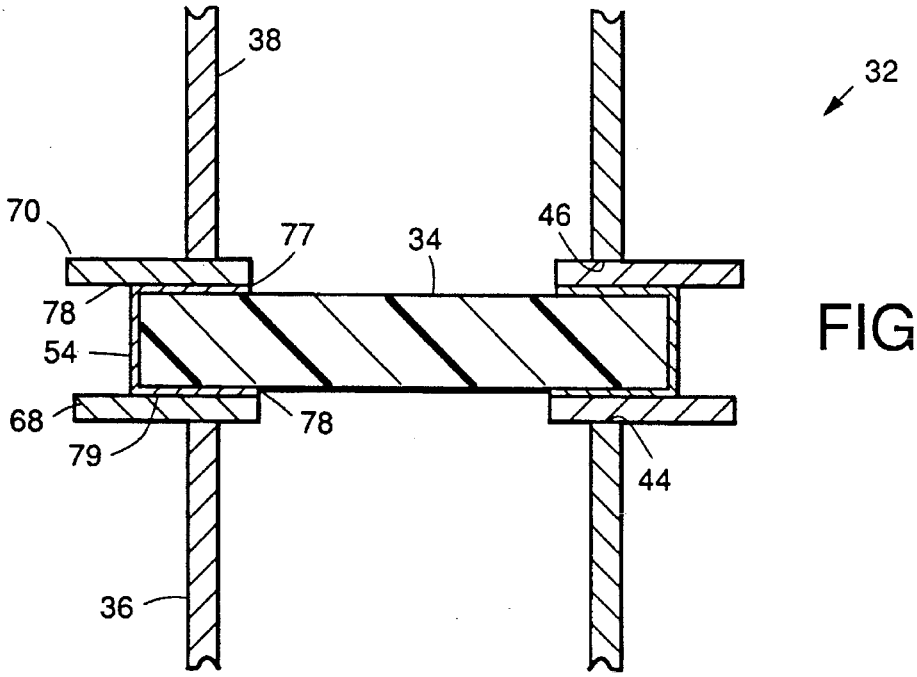
FIGS. 7*a* and 7*b* are enlarged fragmentary sectional views of the EM window shown in FIG. 4 before and after brazing, respectively.
Figure 7B:
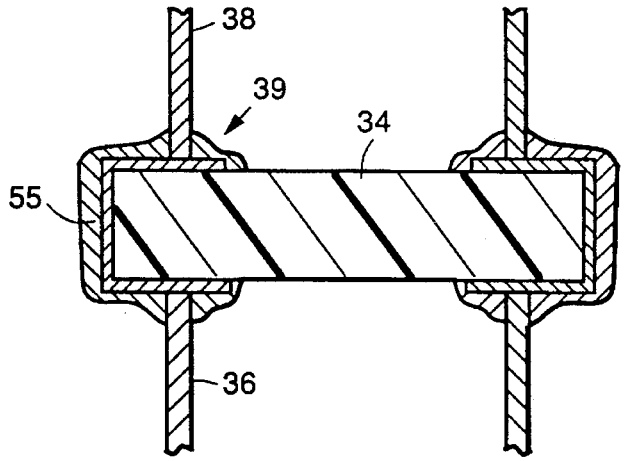

FIGS. 7*a* and 7*b* show the RF window 32 before and after brazing, respectively. The window is suitably heated at approximately 1000° C. for several hours to liquify the braze forms, allowing the brazing material to reflow and cover the insert's peripheral edge 54. The window is allowed to cool so that the brazing material solidifies with a thickness of approximately 0.0013 cm, as shown in FIG. 7*b*, to form the hermetic seal 39 and provide an electrical path 55 between the two waveguide segments.

Placing the oversized insert 34 between the knife edges creates overhangs 78 and 79. The seal is strengthened by reflowing brazing material along the overhangs as well as the interior junctures of the knife edges and insert. Oversizing the insert also reduces the problems associated with thermal expansion during brazing. Although the waveguide segments still expand more than the insert, they expand along the insert's surface instead of pulling away from the insert's peripheral edge: the integrity of the seal is thus maintained with less flexibility at the knife edges.

A primary advantage of the invention is that the machining tolerances of the knife edges and particularly the insert are relaxed by placing the insert between the waveguides' knife edges. The waveguide and insert do not have to be machined to the exacting tolerances required to position the insert inside the waveguide. Furthermore, by brazing the insert to the end of each waveguide segment, the special tool previously required to position the insert perpendicular to the waveguide's inner walls is not needed.

The braze forms are the preferred method for providing brazing material because they are simple to position and provide a high quality seal. However, the seal could be formed by placing discrete drops of brazing material along the knife edges at close enough intervals to reflow and form a contiguous seal. Braze material could also be vapor deposited along the periphery of the insert's top and bottom surfaces, or two wire loops could be placed along either the interior or exterior junctures of the insert and the waveguide segments.

Figure 8:
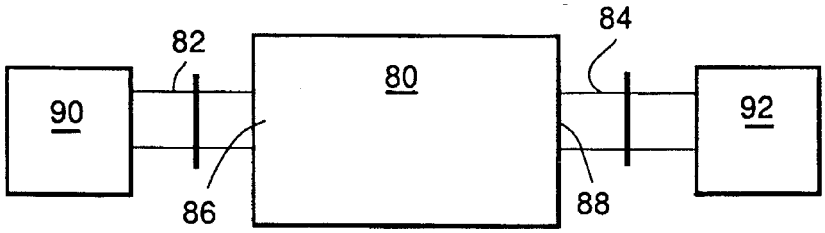
FIG. 8 is a perspective view of a vacuum sealed EM device.

As shown in FIG. 8, an RF device 80 such as an RF amplifier can be vacuum sealed by using hermetically sealed RF windows 82 and 84 to seal its input and output ports 86 and 88, respectively. The input port can be coupled to, for example, a radar transmitter 90 and the output port may be coupled to an antenna system 92. Vacuum sealing the RF amplifier prevents oxidation that would degrade its performance and shorten its lifetime. Also, increased voltage stand off across surfaces and gaps can be achieved.

While several illustrative embodiments of the invention have been shown and described, numerous variations and alternate embodiment will occur to those skilled in the art. Such variations and alternate embodiments are contemplated, and can be made without departing from the spirit and scope of the invention as defined in the appended claims.

I claim:

1. A hermetically sealed electromagnetic (EM) window, comprising:

first and second waveguide segments each having segment walls that are thinned at one end into respective knife edges, said first and second waveguide segments being positioned with their knife edges facing each other;

a dielectric insert positioned between the knife edges of said waveguide segments; and a brazing material adhered between said insert and said knife edges and providing a hermetic seal between said insert and said waveguide segments.

2. The EM window of claim 1, wherein said insert and said waveguide segments have respective cross sectional areas, said insert cross-sectional area being greater than said waveguide segment cross-sectional areas such that said insert overhangs said first and second knife edges.

3. The EM window of claim 2, wherein said insert cross sectional area is approximately five to ten percent larger than said waveguide segment cross-sectional areas.

4. The EM window of claim 2, said waveguide segments and said insert having respective thermal coefficients of expansion, wherein the thermal coefficient of expansion for said insert is less than for said waveguide segments.

5. The EM window of claim 2, wherein said insert and waveguide segments have generally the same cross-sectional shapes.

6. The EM window of claim 1, wherein said insert has a peripheral edge, with said brazing material adhering to said peripheral edge to form a conductive path between said waveguide segments.

7. The EM window of claim 6, wherein said insert's peripheral edge is metalized.

8. The EM window of claim 6, wherein said insert overhangs said first and second knife edges such that said brazing material adheres to the insert to strengthen the hermetic seal.

9. The EM window of claim 1, wherein the segment walls of said waveguide segments and of said knife edges have respective thicknesses, wherein the thicknesses of the segment walls at the waveguide segments are greater than the thicknesses at said knife edge.

10. The EM window of claim 9, wherein said waveguide knife edges have widths that are at least four times their thicknesses.

11. The EM window of claim 10, wherein said waveguide thickness is at least twice said knife edge thickness.

12. A hermetically sealed electromagnetic (EM) device, comprising:

an EM device for processing EM signals in a predetermined atmosphere, said device having input and output ports for transmitting said EM signals;

a first EM window hermetically sealing said input port, said first EM window comprising:

a first pair of waveguide segments each having segment walls which are thinned at one end into knife edges; and a first dielectric insert that is butt end brazed between the knife edges of the first pair of waveguide segments; and a second EM window hermetically sealing said output port, said second EM window comprising:

a second pair of waveguide segments each having segment walls which are thinned at one end into knife edges; and a second dielectric insert that is butt end brazed between the knife edges of the second pair of waveguide segments;

said first and second EM windows providing a hermetic seal for said EM device to maintain said predetermined atmosphere.

13. The EM device of claim 12, wherein said predetermined atmosphere is substantially a vacuum.

14. The EM device of claim 12, wherein said first and second dielectric inserts overhang the knife edges of their respective pairs of waveguide segments.

15. The EM device of claim 14, wherein the waveguide segments of said first and second pairs are electrically connected across their respective dielectric inserts by their respective butt end brazes.

16. A method for forming a hermetically sealed electromagnetic (EM) window, comprising:

providing first and second waveguide segments each having segment walls that are thinned into a knife edge at one end, such that respective knife edges are opposed; P1 inserting a dielectric insert between the opposed knife edges of said first and second waveguide segments; and brazing said knife edges to said dielectric insert.

17. The method of claim 16, wherein said brazing step comprises:

placing respective brazing forms between said knife edges and said insert;

heating said brazing forms such that they reflow between said waveguide segments and said insert; and cooling said brazing.

18. Thc method of claim 17, wherein said brazing forms overhang said dielectric insert such that when said forms are heated they reflow together to form a conductive path between said first and second waveguide segments.

19. The method of claim 18, wherein said dielectric insert overhangs said first and second waveguide segments.

20. A method for forming a hermetically sealed electromagnetic (EM) window, comprising:

providing a pair of waveguide segments each one of the pair having segment walls that are thinned into a knife edge at one end, such that respective knife edges are opposed;

butt end brazing a dielectric insert to the opposed knife edges of the pair of waveguide segments, wherein the dielectric insert overhangs said waveguide segments between the opposed knife edges.

* * * * *